US006056207A

United States Patent [19]

Larson

[11] Patent Number: 6,056,207

[45] Date of Patent: May 2, 2000

[54] CLEANER WITH TEMPERATURE CONTROL

[75] Inventor: Arden L. Larson, Sioux Falls, S. Dak.

[73] Assignee: Sioux Steam Cleaner Corporation, Beresford, S. Dak.

[21] Appl. No.: 09/070,572

[22] Filed: Apr. 30, 1998

[51] Int. Cl.[7] ..... B05B 7/00

[52] U.S. Cl. ..... 239/61; 239/75; 239/124; 239/127; 239/135

[58] Field of Search ..... 239/10, 61, 67, 239/69, 99, 128, 135, 130, 124, 139, 398, 416.2, 423, 426, 127, 75, 310, 78, 133, 420; 392/479, 480, 482, 485, 486, 488, 495; 137/341

[56] References Cited

U.S. PATENT DOCUMENTS

| | | | |
|---|---|---|---|
| D. 354,753 | 1/1995 | Turner, III et al. . | |
| 2,295,228 | 9/1942 | Malsbary et al. . | |
| 2,345,614 | 4/1944 | Malsbary et al. . | |
| 2,641,508 | 6/1953 | Stoner et al. . | |
| 2,987,259 | 6/1961 | Lindquist | 239/130 |
| 3,383,044 | 5/1968 | Norstrud et al. . | |
| 3,438,580 | 4/1969 | Siebring . | |
| 3,522,909 | 8/1970 | Arant . | |
| 3,556,402 | 1/1971 | Wolking | 239/130 |
| 3,645,420 | 2/1972 | Machado . | |
| 3,684,172 | 8/1972 | Evalds | 239/78 |
| 3,760,982 | 9/1973 | Haase . | |
| 3,785,363 | 1/1974 | Machado . | |
| 3,997,114 | 12/1976 | Hewett . | |
| 4,034,203 | 7/1977 | Cooper . | |
| 4,046,321 | 9/1977 | Hewett | 239/420 |
| 4,197,872 | 4/1980 | Parker . | |
| 4,263,091 | 4/1981 | King . | |
| 4,308,636 | 1/1982 | Davis . | |
| 4,687,138 | 8/1987 | Ostergaard . | |
| 4,773,592 | 9/1988 | Oberdorfer . | |
| 4,947,025 | 8/1990 | Alston et al. . | |
| 5,174,723 | 12/1992 | Groger et al. . | |
| 5,282,590 | 2/1994 | Zwick | 239/133 |
| 5,366,154 | 11/1994 | Thompson | 239/130 |
| 5,385,106 | 1/1995 | Langshaw | 239/135 |
| 5,458,294 | 10/1995 | Zachary et al. . | |
| 5,529,460 | 6/1996 | Eihusen et al. . | |
| 5,533,671 | 7/1996 | Baer . | |
| 5,551,857 | 9/1996 | Fujioka et al. | 425/143 |
| 5,645,217 | 7/1997 | Warren | 239/135 |
| 5,662,269 | 9/1997 | Francis . | |

FOREIGN PATENT DOCUMENTS

| | | |
|---|---|---|
| 0 144 047 | 12/1985 | European Pat. Off. . |
| WO 91/11021 | 7/1991 | Japan . |
| 2053741 | 2/1981 | United Kingdom . |
| WO 89/01828 | 3/1989 | WIPO . |

*Primary Examiner*—Andres Kashnikow
*Assistant Examiner*—Dinh Q. Nguyen
*Attorney, Agent, or Firm*—Kaardal & Associates, PC

[57] ABSTRACT

A cleaner with temperature control is provided including a fluid tank for containing a supply of water and at least one pump for suctioning water from the fluid tank. Also included is a heating element in communication with the pump for heating water received therefrom. A heating element control mechanism is provided for controlling the temperature of the water exiting the heating element such that it transitions smoothly to a constant predetermined temperature.

14 Claims, 3 Drawing Sheets

PRIOR ART

CLEANER WITH TEMPERATURE CONTROL

BACKGROUND OF THE INVENTION

1. Field of the Invention

The present invention relates to cleaners and more particularly pertains to a new cleaner with temperature control for controlling a temperature of water expelled from a cleaner.

2. Description of the Prior Art

The use of cleaners is known in the prior art. More specifically, cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaners include U.S. Pat. No. 5,551,857; U.S. Pat. No. 5,197,537; U.S. Pat. No. 4,807,445; U.S. Pat. No. 5,173,224; U.S. Pat. No. 4,675,798; U.S. Pat. No. 4,979,011; U.S. Pat. No. 3,684,172; U.S. Pat. No. 5,325,678; U.S. Pat. No. 4,993,480; U.S. Pat. No. 5,051,121; U.S. Pat. No. 5,384,526; U.S. Pat. No. Des. 320,384; Foreign Patent PCT WO 90/02826; Foreign Patent PCT WO 90/12556; Foreign Patent PCT WO 89/12527; Foreign Patent EPO 161 891 A2; and Foreign Patent EPO 0 149 928 A1.

In these respects, the cleaner with temperature control according to the present invention substantially departs from the conventional concepts and designs of the prior art, and in so doing provides an apparatus primarily developed for the purpose of controlling a temperature of water expelled from a cleaner.

SUMMARY OF THE INVENTION

In view of the foregoing disadvantages inherent in the known types of cleaners now present in the prior art, the present invention provides a new cleaner with temperature control construction wherein the same can be utilized for controlling a temperature of water expelled from a cleaner.

The general purpose of the present invention, which will be described subsequently in greater detail, is to provide a new cleaner with temperature control apparatus and method which has many of the advantages of the cleaners mentioned heretofore and many novel features that result in a new cleaner with temperature control which is not anticipated, rendered obvious, suggested, or even implied by any of the prior art cleaners, either alone or in any combination thereof.

To attain this, the present invention generally comprises a fluid tank for containing a supply of water. As shown in FIG. 1, a pair of pumps each have an inlet conduit connected to the fluid tank. When actuated, the pumps serve for suctioning water therefrom and expelling the same from an output thereof. Next provided is an unloader valve having an input connected to the outputs of the pumps. A first output is connected to the fluid tank via a bypass conduit. The unloader valve further has a second output. In operation, the unloader valve has a first mode of operation during normal use for passing the water from the input thereof to the second output thereof. While in a second mode of operation, the unloader valve directs water from the input to the first output whenever back flow pressure is received from the second output. Connected to the second output of the unloader valve is a flow switch. The flow switch is adapted to generate an activation signal only when a flow rate of water from the unloader valve is at least a minimum amount. Associated therewith is a temperature switch which is also connected to the second output of the unloader valve. The temperature switch functions to generate the activation signal only when a temperature of the water remains below a maximum amount. With reference still to FIG. 1, a heating element is depicted in communication with the second output of the unloader valve. Further, the heating element is positioned between the flow switch and the temperature switch. It should be noted that the heating element is connected to the flow switch and the temperature switch for heating water received from the unloader valve only upon the receipt of the activation signal from both the flow switch and the temperature switch. With reference now to FIG. 2, a heating element control means is shown to include a thermocouple mounted on an outlet of the heating element. The thermocouple is adapted for generating a temperature signal commensurate with a temperature of the water exiting the heating element. Connected to the thermocouple is a PID controller for generating a control signal corresponding to a temperature represented by the temperature signal. A silicon controlled rectifier is connected to the PID controller for governing an amount of power supplied to the heating element. This is accomplished by way of a power regulator which is governed in accordance with the control signal. By the foregoing structure, the temperature of the water exiting the heating element transitions smoothly to a constant predetermined temperature. Note FIG. 3. With reference again to FIG. 1, an additive injection assembly is provided including an additive reservoir for containing a predetermined amount of cleaning solution. For injecting the cleaning solution into the water, a siphon injector is connected between the additive reservoir and the inlet conduit of one of the pumps. A solenoid is situated between the additive reservoir and the siphon injector. The solenoid is further connected to the flow switch and a push button switch. In use, the solenoid allows the flow of cleaning solution to the siphon injector only upon depression of the switch and the receipt of the activation signal from the flow switch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaner with temperature control apparatus and method which has many of the advantages of the cleaners mentioned heretofore and many novel features that result in a new cleaner with temperature control which is not anticipated, rendered obvious, suggested, or even implied by any of the prior art cleaners, either alone or in any combination thereof.

It is another object of the present invention to provide a new cleaner with temperature control which may be easily and efficiently manufactured and marketed.

It is a further object of the present invention to provide a new cleaner with temperature control which is of a durable and reliable construction.

An even further object of the present invention is to provide a new cleaner with temperature control which is susceptible of a low cost of manufacture with regard to both materials and labor, and which accordingly is then susceptible of low prices of sale to the consuming public, thereby making such cleaner with temperature control economically available to the buying public.

Still yet another object of the present invention is to provide a new cleaner with temperature control which provides in the apparatuses and methods of the prior art some of the advantages thereof, while simultaneously overcoming some of the disadvantages normally associated therewith.

Still another object of the present invention is to provide a new cleaner with temperature control for controlling a temperature of water expelled from a cleaner.

Even still another object of the present invention is to provide a new cleaner with temperature control that includes a fluid tank for containing a supply of water and at least one pump for suctioning water from the fluid tank. Also included is a heating element in communication with the pump for heating water received therefrom. A heating element control mechanism is provided for controlling the temperature of the water exiting the heating element such that it transitions smoothly to a constant predetermined temperature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
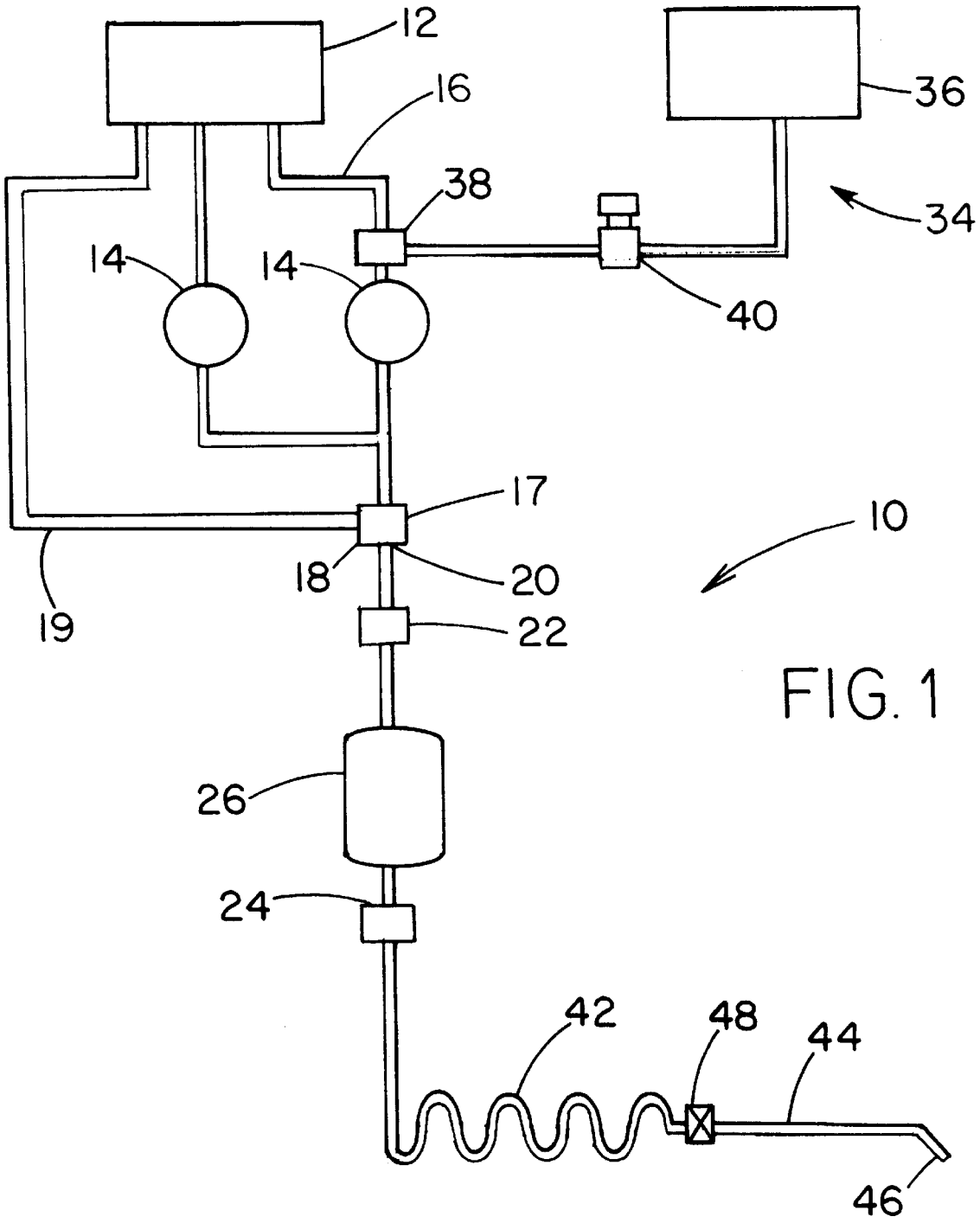
FIG. 1 is a schematic diagram of a new cleaner with temperature control according to the present invention. 8
Figure 2:
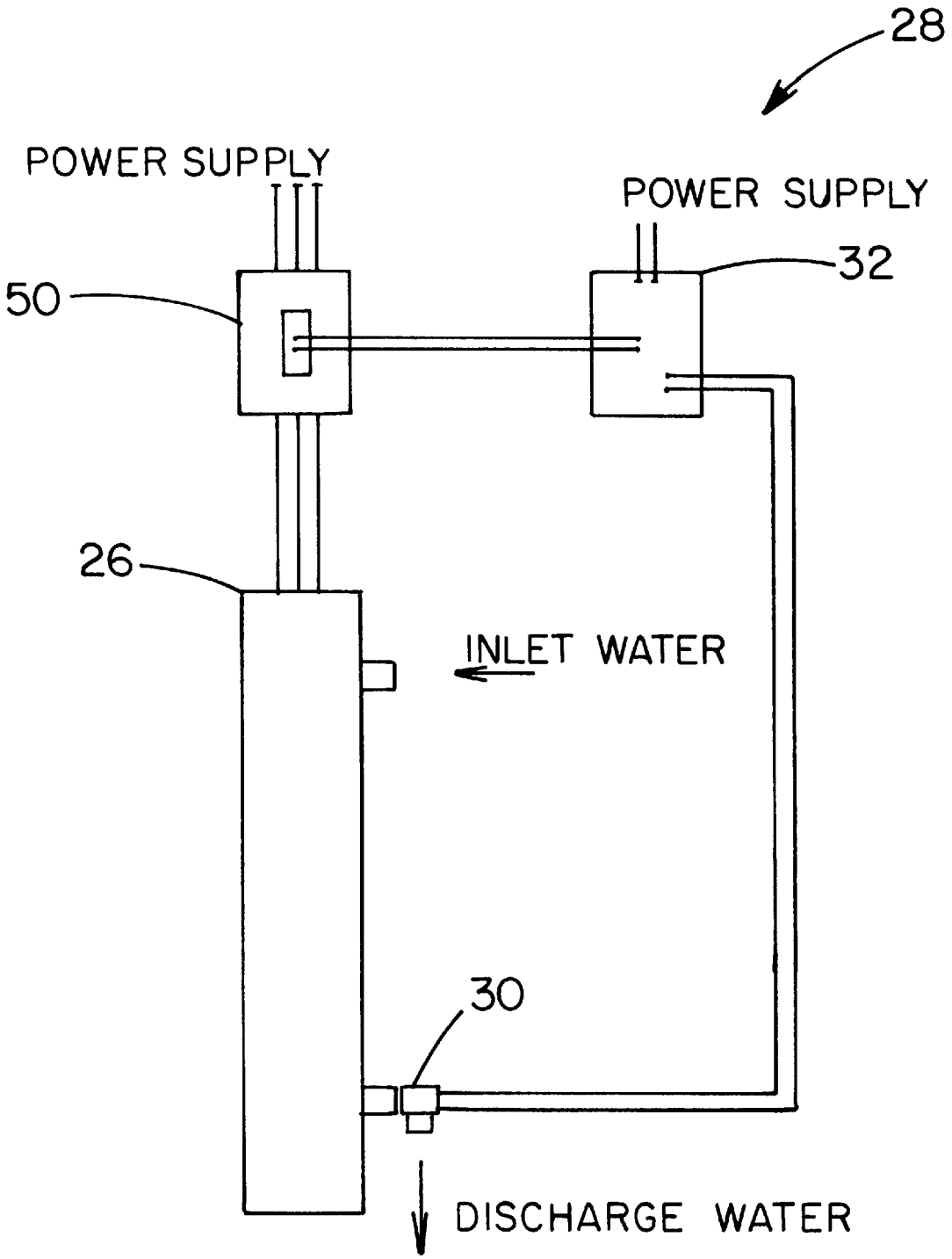
FIG. 2 is a schematic diagram of the heating element control means of the present invention.
Figure 3:
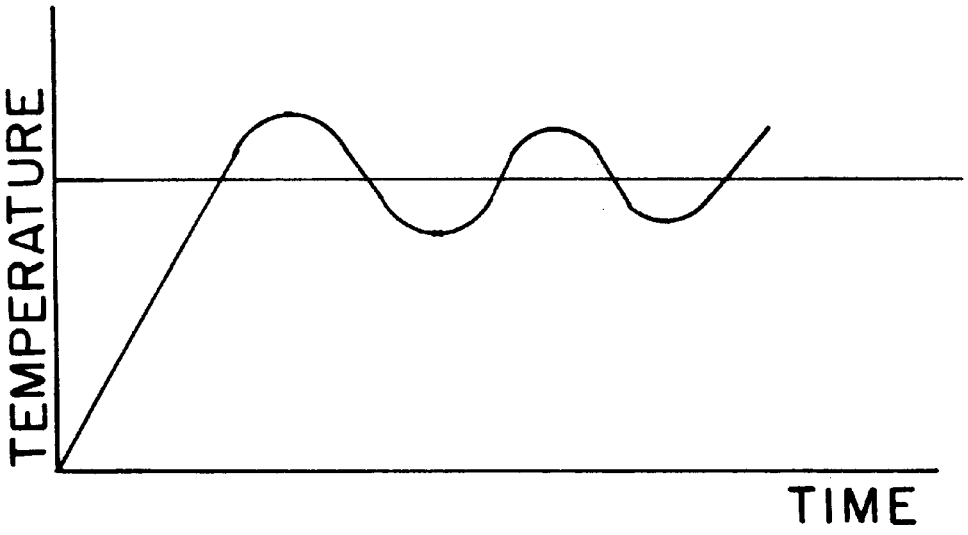
FIG. 3 is a graph depicting the temperature of the water, as a function of time, within the systems of the prior art and that of the present invention.
Figure 3:
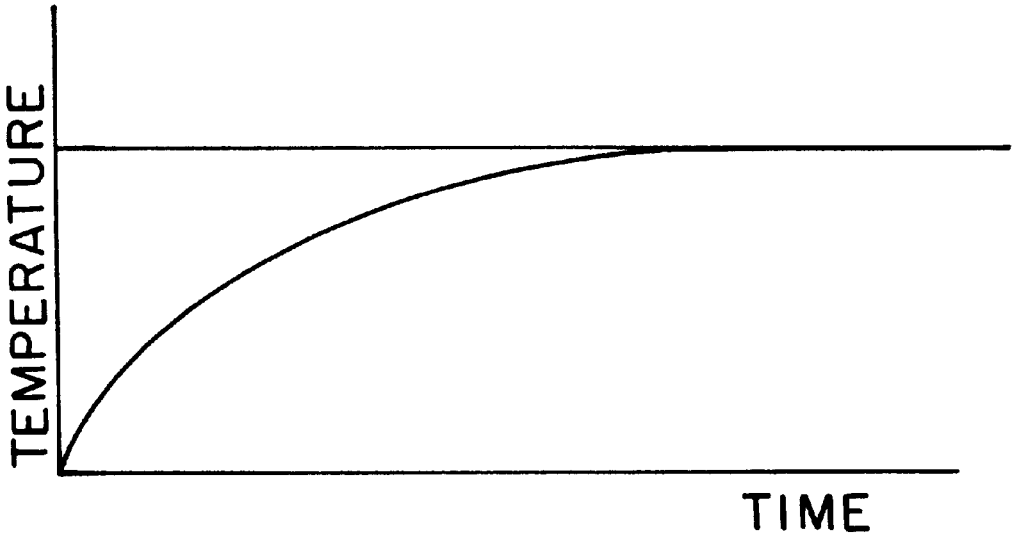

With reference now to the drawings, and in particular to FIGS. 1 through 3 thereof, a new cleaner with temperature control embodying the principles and concepts of the present invention and generally designated by the reference numeral 10 will be described.

The present invention, designated as numeral 10, includes a fluid tank 12 for containing a supply of water. As shown in FIG. 1, a pair of pumps 14 each have an inlet conduit 16 connected to the fluid tank. When actuated, the pumps serve for suctioning water from the fluid tank and expelling the same from an output thereof. Such actuation is preferably effected by way of an unillustrated control panel.

Next provided is an unloader valve 17 having an input connected to the outputs of the pumps. A first output 18 of the unloader valve is connected to the fluid tank via a bypass conduit 19. The unloader valve further has a second output 20. In operation, the unloader valve has a first mode of operation during normal use for passing the water from the input to the second output thereof. While in a second mode of operation, the unloader valve directs water from the input to the first output whenever back flow pressure is received from the second output. As such, the unloader valve acts as a one way valve that redirects back flow water.

Connected to the second output of the unloader valve is a flow switch 22. The flow switch is a normally open switch which generates an activation signal only when a flow rate of water from the unloader valve is at least a minimum amount. Associated therewith is a temperature switch 24 which is also connected to the second output of the unloader valve. The temperature switch is a normally open switch which generates the activation signal only when a temperature of the water remains below a maximum amount.

With reference still to FIG. 1, a heating element 26 is depicted in communication with the second output of the unloader valve. Further, the heating element is positioned between the flow switch and the temperature switch. Ideally, the heating element takes the form of a coil or the like. It should be noted that the heating element is connected to the flow switch and the temperature switch for heating water received from the unloader valve only upon the receipt of the activation signal from both the flow switch and the temperature switch. As such, whenever the temperature and flow rate of the water deviates undesirably, the heating element deactuates and re-actuates once the conditions are again favorable.

With reference now to FIG. 2, a heating element control means 28 is shown to include a thermocouple 30 mounted on an outlet of the heating element. The thermocouple is adapted for generating a temperature signal commensurate with a temperature of the water exiting the heating element. Connected to the thermocouple is a PID controller 32 for generating a 4–20 mA control signal corresponding to a temperature represented by the temperature signal. A silicon controlled rectifier(SCR) 50 is connected to the PID controller for governing an amount of power supplied to the heating element. This is accomplished by way of a power regulator which is governed in accordance with the control signal.

By the foregoing structure, the temperature of the water exiting the heating element transitions smoothly to a constant predetermined temperature. Note FIG. 3. It should be understood that the PID controller detects a rate of temperature change of the water for increasing and decreasing the rate of power flow to the heater by way of the SCR and power regulator such that the temperature does not overshoot and/or undershoot the desired temperature, as is common in the prior art. Note FIG. 3. In the preferred embodiment, the desired temperature is manually selected with an unillustrated dial connected to the PID controller. Further, the PID may be programmable to perform an auto-tuning procedure for anticipating the heating response for a given condition.

With reference again to FIG. 1, an additive injection assembly 34 is provided including an additive reservoir 36 for containing a predetermined amount of cleaning solution. For injecting the cleaning solution into the water, a siphon injector 38 is connected between the additive reservoir and the inlet conduit of one of the pumps. By this unique point of injection, the cleaning solution is not subjected to the high pressures present in the remaining system. A solenoid 40 is situated between the additive reservoir and the siphon injector. The solenoid is further connected to the flow switch and an unillustrated push button switch. In use, the solenoid allows the flow of cleaning solution to the siphon injector only upon the depression of the switch and the receipt of the activation signal from the flow switch. As such, no cleaning solution is injected when the system lacks a flow of water.

Also included is an elongated flexible hose 42 connected to the heating element for receiving heated water therefrom. Coupled to the flexible hose is a spray gun 44 which includes a wash tip 46 for controlling the flow of water from the gun. The gun is also equipped with a shut off valve 48 for selectively precluding the flow of water from the gun. It should be noted that any back flow of water resulting from the use of the shut off valve is released through the bypass conduit 19 of the unloader valve. As an option, the present system may be equipped with a pressure switch and pressure release valve for detecting and releasing excess water pressure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaner with temperature control comprising, in combination:

a fluid tank for containing a supply of water;

a pair of pumps each having an inlet conduit connected to the fluid tank for suctioning water therefrom and expelling the same from an output thereof when actuated;

an unloader valve having an input connected to the outputs of the pumps, a first output connected to the fluid tank via a bypass conduit, and a second output, the unloader valve having a first mode of operation during normal use for passing the water from the input thereof to the second output thereof and a second mode of operation for directing water from the input to the first output only when back flow water is received from the second output;

a flow switch connected to the second output of the unloader valve and adapted to generate an activation signal only when a flow rate of water from the unloader valve is at least a minimum amount;

a temperature switch connected to the second output of the unloader valve and adapted to generate the activation signal only when a temperature of the water remains below a maximum amount;

a heating element in communication with the second output of the unloader valve and positioned between the flow switch and the temperature switch, the heating element connected to the flow switch and the temperature switch for heating water received from the unloader valve only upon the receipt of the activation signal from both the flow switch and the temperature switch;

a heating element control means including a thermocouple mounted on an outlet of the heating element for generating a temperature signal commensurate with a temperature of the water exiting the heating element, a PID controller connected to the thermocouple for generating a control signal corresponding to a temperature represented by the temperature signal, and a silicon controlled rectifier connected to the PID controller for governing an amount of power supplied to the heating element by way of a power regulator in accordance with the control signal, wherein the temperature of the water exiting the heating element transitions smoothly to a constant predetermined temperature;

an additive injection assembly including an additive reservoir for containing a predetermined amount of cleaning solution, a siphon injector connected between the additive reservoir and the inlet conduit of one of the pumps for injecting the cleaning solution into the water upon the receipt thereof, and a solenoid situated between the additive reservoir and the siphon injector and further connected to the flow switch and a push button switch for allowing the flow of cleaning solution to the siphon injector only upon depression of the switch and the receipt of the activation signal from the flow switch;

an elongated flexible hose connected to the heating element for receiving heated water therefrom; and a spray gun coupled to the flexible hose and including a wash tip for controlling the flow of water from the gun and a shut off valve for selectively precluding the flow of water from the gun.

2. A cleaner with temperature control comprising:

a fluid tank for containing a supply of water;

at least one pump for suctioning water from the fluid tank;

an electrically-powered heating element in communication with the pump for heating a flow of water received from the pump; and a heating element control means for controlling the flow of electrical power to the heating element for controlling the temperature of the water exiting the heating element such that it is maintained at a constant predetermined temperature;

wherein the heating element control means includes a temperature sensor for sensing the temperature of water exiting the heating element, the temperature sensor generating a temperature signal commensurate with the temperature of the water exiting the heating element, a PID controller being connected to the temperature sensor for generating a control signal corresponding to a temperature represented by the temperature signal, and a silicon controlled rectifier connected to the PID controller for controlling the flow of electrical power to the heating element in accordance with the control signal.

3. A cleaner with temperature control as set forth in claim 2 wherein the temperature sensor of the heating element control means includes a thermocouple.

4. A cleaner with temperature control as set forth in claim 2 and further including an additive injection assembly having an additive reservoir for containing cleaning solution, and a solution injector for injecting the cleaning solution into the flow of water.

5. A cleaner with temperature control as set forth in claim 4 and further including a solenoid situated between the additive reservoir and the solution injector, the solenoid being connected to a switch for allowing the flow of cleaning solution to the solution injector only upon the actuation of the switch.

6. A cleaner with temperature control as set forth in claim 5 wherein the solenoid allows the flow of cleaning solution to the solution injector only when the flow of water through the cleaner exceeds a predetermined flow.

7. A cleaner with temperature control as set forth in claim 2 and further including an unloader valve connected between the pump, the fluid tank and the heating element for passing water from the heating element to the fluid tank when back flow water is received.

8. A cleaner with temperature control as set forth in claim 2 wherein the heating element is adapted to heat the water only when the flow of the water exceeds a minimum flow amount.

9. A cleaner with temperature control as set forth in claim 2 wherein the heating element is adapted to heat the water only when the temperature of the water is less than a maximum flow amount.

10. A cleaner with temperature control as set forth in claim 2 and further including an elongated flexible hose connected to the heating element for receiving heated water therefrom and a spray gun coupled to the flexible hose and a shut off valve for selectively precluding the flow of water from the gun.

11. A cleaner with temperature control as set forth in claim 2 wherein the water exiting the heating element is heated such that it transitions smoothly to the constant predetermined temperature.

12. A cleaner with temperature control comprising:

a fluid tank for containing a supply of water;

a pair of pumps each having an inlet conduit connected to the fluid tank for suctioning water from the fluid tank and expelling the water from an output of the pump when the pump is actuated;

an unloader valve having an input connected to the outputs of the pumps, the unloader valve having a first output and a second output, the first output being connected to the fluid tank through a bypass conduit, the unloader valve having a first mode of operation during normal use for passing the water from the input of the unloader valve to the second output of the unloader valve, and a second mode of operation for directing water from the input of the unloader valve to the first output of the unloader valve only when back flow water is received from the second output of the unloader valve;

a flow switch connected to the second output of the unloader valve, the flow switch being adapted to generate an activation signal only when a flow rate of water from the unloader valve exceeds a minimum amount;

a temperature switch connected to the second output of the unloader valve, the temperature switch being adapted to generate the activation signal only when a temperature of the water falls below a maximum amount;

a heating element in communication with the second output of the unloader valve and positioned between the flow switch and the temperature switch, the heating element being connected to the flow switch and the temperature switch for heating water received from the unloader valve only upon the receipt of the activation signal from both the flow switch and the temperature switch, the heating element having an outlet; and a heating element control means including a thermocouple at the outlet of the heating element, the thermocouple generating a temperature signal commensurate with a temperature of the water exiting the outlet of the heating element, a PID controller being connected to the thermocouple for generating a control signal corresponding to a temperature represented by the temperature signal, and a silicon controlled rectifier connected to the PID controller for governing an amount of electrical power supplied to the heating element by way of a power regulator in accordance with the control signal, wherein the temperature of the water exiting the heating element transitions smoothly to a constant predetermined temperature.

13. The cleaner of claim 12 additionally comprising an additive injection assembly comprising an additive reservoir for containing a predetermined amount of cleaning solution, a siphon injector connected between the additive reservoir and the inlet conduit of one of the pumps for injecting the cleaning solution into the water, and a solenoid situated between the additive reservoir and the siphon injector, the solenoid being connected to the flow switch and a push button switch for allowing the flow of cleaning solution to the siphon injector only upon depression of the switch and the receipt of the activation signal from the flow switch.

14. The cleaner of claim 12 additionally comprising an elongated flexible hose connected to the heating element for receiving heated water therefrom, and a spray gun coupled to the flexible hose, the spray gun including a wash tip for controlling the flow of water from the gun and a shut off valve for selectively precluding the flow of water from the gun.

* * * * *